US007103925B2

(12) United States Patent
Toth

(10) Patent No.: US 7,103,925 B2
(45) Date of Patent: Sep. 12, 2006

(54) ODOR ELIMINATING SYSTEM FOR A TOILET, TOILET INCLUDING THE ODOR ELIMINATING SYSTEM, AND TOILET SEAT ASSEMBLY

(76) Inventor: Lajos Toth, 320 83rd St., Miami Beach, FL (US) 33141

( * ) Notice: Subject to any disclaimer, the term of this patent is extended or adjusted under 35 U.S.C. 154(b) by 0 days.

(21) Appl. No.: 10/931,423

(22) Filed: Sep. 1, 2004

(65) Prior Publication Data

US 2006/0041995 A1 Mar. 2, 2006

(51) Int. Cl.
*E03D 9/052* (2006.01)

(52) U.S. Cl. ..... 4/213; 4/216; 4/217; 4/351

(58) Field of Classification Search ..... 4/213, 4/216, 217, 351
See application file for complete search history.

(56) References Cited

U.S. PATENT DOCUMENTS

| | | | | | |
|---|---|---|---|---|---|
| 3,335,431 | A | | 8/1967 | Coates | 4/213 |
| 3,533,112 | A | | 10/1970 | Poister | 4/217 |
| 3,805,304 | A | | 4/1974 | Ikehata | 4/213 X |
| 3,857,119 | A | | 12/1974 | Hunnicutt, Jr. | 4/217 X |
| 3,902,203 | A | | 9/1975 | Poister et al. | 4/213 |
| 3,916,459 | A | | 11/1975 | Ivancevic | 4/217 X |
| 4,059,857 | A | | 11/1977 | Poister | 4/213 |
| 4,094,023 | A | | 6/1978 | Smith | 4/213 |
| 4,103,370 | A | * | 8/1978 | Arnold | 4/213 |
| 4,133,060 | A | * | 1/1979 | Webb | 4/216 |
| 4,222,129 | A | | 9/1980 | Baker | 4/213 |
| 4,251,888 | A | | 2/1981 | Turner | 4/217 X |
| 4,344,194 | A | * | 8/1982 | Pearson | 4/213 |
| 4,365,361 | A | | 12/1982 | Sanstrom | 4/213 |
| 4,556,999 | A | | 12/1985 | Lindley | 4/217 |
| 4,620,329 | A | | 11/1986 | Wix | 4/217 |
| 4,780,913 | A | | 11/1988 | Williams | 4/217 |
| 4,944,045 | A | | 7/1990 | Agelatos et al. | 4/217 X |
| 4,984,305 | A | | 1/1991 | Boisvert | 4/213 |
| 4,993,083 | A | | 2/1991 | Lemieux | 21/213 |
| 5,016,294 | A | | 5/1991 | Canovas | 4/217 |
| 5,054,131 | A | | 10/1991 | Sim | 4/216 |
| 5,079,782 | A | | 1/1992 | Sim | 4/216 |
| 5,193,227 | A | | 3/1993 | Crowley, Jr. | 4/213 |
| 5,255,395 | A | | 10/1993 | Millette | 4/216 |
| 5,555,572 | A | | 9/1996 | Hunnicutt, Jr. | 4/213 |
| 5,638,553 | A | | 6/1997 | Loewen et al. | 4/217 |
| 5,704,074 | A | | 1/1998 | Baldea | 4/213 |
| 5,724,682 | A | | 3/1998 | Johnson | 4/217 |
| 5,850,638 | A | | 12/1998 | Her | 4/217 X |
| 5,898,951 | A | | 5/1999 | Rakoz | 4/217 |
| 6,016,576 | A | | 1/2000 | Happe | 4/217 X |
| 6,055,677 | A | | 5/2000 | McKinley | 4/217 |
| 6,073,273 | A | | 6/2000 | Tillen | 4/214 |
| 6,173,453 | B1 | | 1/2001 | Shahar | 4/213 |
| 6,237,163 | B1 | | 5/2001 | Guzzo et al. | 4/217 X |
| 6,298,500 | B1 | | 10/2001 | Sollami | 4/217 |
| 6,499,150 | B1 | | 12/2002 | Thompson | 4/213 |

(Continued)

*Primary Examiner*—Robert M. Fetsuga
(74) *Attorney, Agent, or Firm*—Laurence A. Greenberg; Werner H. Stemer; Ralph E. Locher

(57) ABSTRACT

An odor eliminating system utilizes an air pump to remove odors from a bowl of a toilet to a trap of the toilet. By moving the odors to the trap, the odors cannot escape back to the bowl and can only proceed out of the toilet to the sewer. The system can be adapted to existing toilets by drilling a channel to the trap or the system can be incorporated into new toilets.

6 Claims, 3 Drawing Sheets

U.S. PATENT DOCUMENTS

| | | | | |
|---|---|---|---|---|
| 6,523,184 | B1 | 2/2003 | Prisco | 4/217 X |
| 6,526,598 | B1 | 3/2003 | Black | 4/217 X |
| 6,546,567 | B1 | 4/2003 | Kuzniar | 4/217 |
| 6,550,072 | B1 | 4/2003 | Ware | 4/213 |
| 6,553,581 | B1 | 4/2003 | Lee | 4/217 |
| 6,567,994 | B1 | 5/2003 | Spurr et al. | 4/217 |
| 6,615,410 | B1 | 9/2003 | Gurrola | 4/217 X |
| 6,637,040 | B1 | 10/2003 | Alba | 4/217 |
| 6,795,980 | B1 * | 9/2004 | Ries | 4/217 |
| 2003/0070212 | A1 | 4/2003 | Brodhead | 4/217 |
| 2003/0145369 | A1 | 8/2003 | Hunnicutt, Jr. et al. | 4/217 |
| 2004/0019960 | A1 | 2/2004 | Kuzniar | 4/217 |

* cited by examiner

ODOR ELIMINATING SYSTEM FOR A TOILET, TOILET INCLUDING THE ODOR ELIMINATING SYSTEM, AND TOILET SEAT ASSEMBLY

BACKGROUND OF THE INVENTION

1. Field of the Invention

The invention relates to systems utilizing an air pump to evacuate odors from a toilet.

2. Description of the Related Art

Most contemporary toilets share common features. A commode is an integrated body (i.e., a cast single piece) with a bowl and a rim. Water, either from a reservoir or a pipe, is piped through the integrated body to outlets beneath the rim when the toilet is flushed. A drain pipe is formed in the integrated body and leads from the bowl to a sewer line. To prevent sewer gases from escaping the sewer line through the drain of the toilet, the drain includes a trap. The trap is formed by a U-shaped section of piping followed by an inverted-U-shaped section of piping. The U-shaped section of pipe remains filled with water, even between flushes. The water in the U-shaped section of pipe blocks the passage of sewer gas.

A problem with the common toilet is that odors accumulate before the toilet can be flushed. Many attempts have been made to provide means for removing these odors.

One set of proposed solutions involves using filter systems to remove odors from the bowl of the toilet and scrub them with a filter before releasing the air back into the room. Any use of filters involves the costs of buying and replacing or regenerating filters. Furthermore, if the filter is spent, the system will pump unfiltered odor-filled air into the room.

Another set of proposed solutions involve using a pump system for removing odors from a toilet bowl to outside of the lavatory. Typically, the odors are pumped to the exterior of the building. This solution requires architectural improvements to be made to the building to allow for passages through which to pump the odor-filled gas. Another shortcoming is that the odors are merely being displaced, not treated or completely removed.

Another set of proposed solutions teach customized toilets that have integrated odor removing systems. The cost of such systems is significantly higher than a system that can be retrofitted to an existing toilet. Furthermore, homeowners will be limited as to the selection of styles and brand of toilets if an integrated system is used.

SUMMARY OF INVENTION

It is accordingly an object of the invention to provide a device for removing odors from a toilet bowl by pumping them to the drain of the toilet downstream of the trap, which overcomes the above-mentioned disadvantages of the heretofore-known devices and methods of this general type With the foregoing and other objects in view there is provided, in accordance with the invention, an odor elimination system for a toilet can be added to a toilet. The system includes an air pump or other similar device for moving air having a pump inlet and a pump outlet. The inlet hose connects to the pump inlet and has an opening. The opening of the inlet hose communicates with the bottom of the seat assembly. The outlet hose is air-tightedly connectable to a channel leading to the trap of an exit pipe formed in the commode.

To retrofit an existing toilet, a channel is drilled in the porcelain unified body of the toilet to a spot above the water level in the inverted-U-section of the trap. To prevent water that is flushed from the toilet from escaping through the channel, the channel should be sloped downward (preferably vertically) into the trap. For example, the channel can be formed by drilling a channel from the top of the toilet, near the seat into the trap. The outlet tube is then connected to the channel. To prevent the odors from escaping and to prevent sewer gases from escaping the trap, the outlet tube must fit in an airtight manner.

In accordance with another feature of the invention, a switch is included for actuating the pump. In the preferred embodiment, the switch is a pressure activated switch that turns on the pump motor when a person sits on the toilet. It is also possible for the switch to be manually actuated on and off by the user. The preferred embodiment, i.e., the pressure-activated switch requires no intervention by the user and it ensures and guarantees the removal of odors at a time when the generation of odors is typically at its peak.

In accordance with another feature of the invention, the inlet house may be connected to a plurality of openings that encircle the seat. That is, the seat has a plurality of holes that are strategically distributed about the opening of the bowl. By having a plurality of inlets holes, odors can be more efficiently and effectively removed from the toilet bowl.

In accordance with another feature of the invention, a simple type of air pump that might be used is a fan. The fan would blow air from the inlet or inlets to the outlet.

In accordance with another feature of the invention, the air pump can be connected to an exterior of the integrated body. In the case of a retrofitted system, the air pump can be bolted or cemented to the integrated body of the toilet.

In accordance with another feature of the invention, the odor removing system is completely integrated into a toilet seat/cover assembly to form a unit. In such a case, the air pump is concealed within the toilet seat cover, the switch is activated by pressure from a person sitting on the commode, the air inlet opening(s) is/are formed in the toilet seat, and the exhausted, odorous air is exhausted into the toilet trap through a hole leading from the seat and cover assembly downward into the trap.

Other features which are considered as characteristic for the invention are set forth in the appended claims.

Although the invention is illustrated and described herein as embodied in an odor eliminating system for retrofitting a toilet and a toilet including the odor eliminating system, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
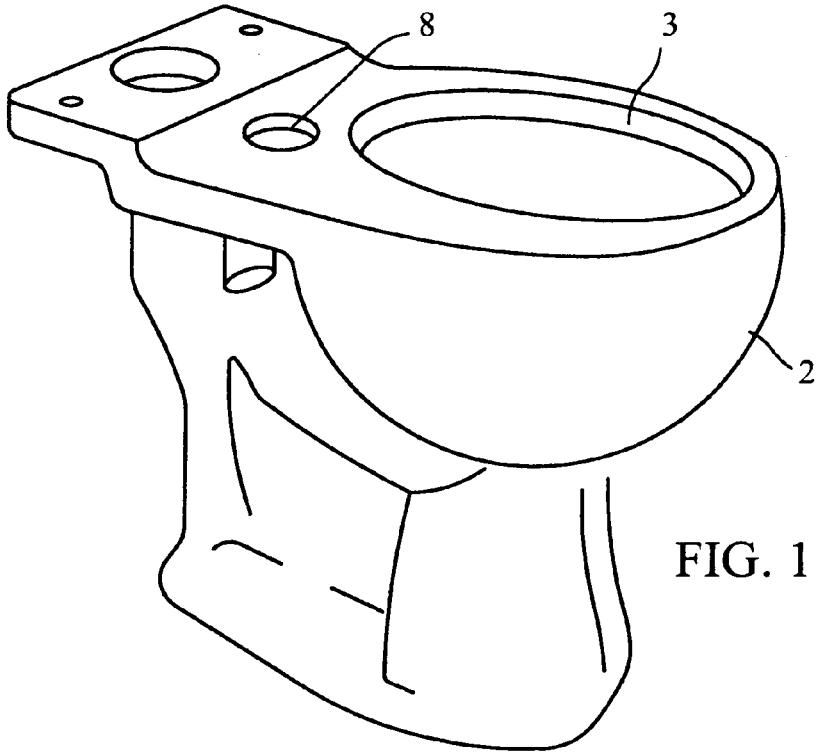
FIG. 1 is a diagrammatic front perspective view of a commode for a toilet prepared for assembly of a system for removing odors according to the invention.
Figure 2:
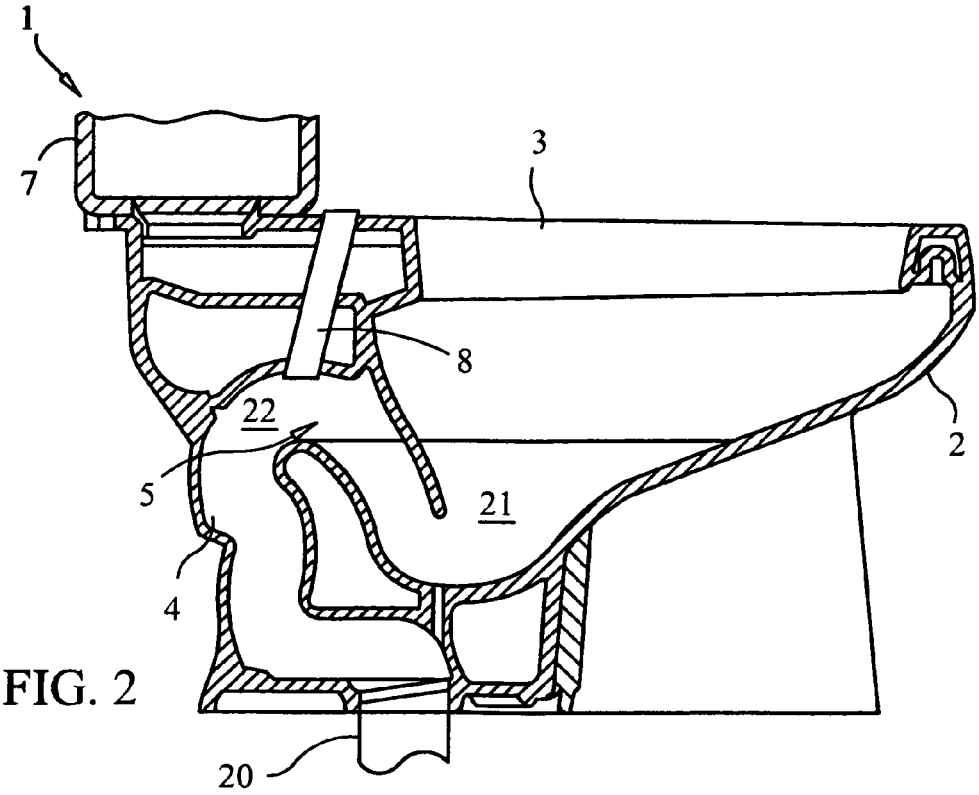
FIG. 2 is a sectional view through a toilet commode.

Referring now to the figures of the drawing in detail and first, particularly, to FIGS. 1 and 2 thereof, there is seen a commode 2 that has been readied for installing a system for removing odors from a toilet. The toilet 1 is a conventional toilet 1 with an integrated body having the bowl or commode 2 with a rim 3. When the toilet 1 is flushed, water is released from a tank 7 and enters the bowl 2 from flush outlets, which are not shown, beneath the rim 3. An exit pipe 4 is connected to the bottom of the bowl 2 and leads to a sewer pipe 20. A trap 5, which includes a U-shaped section 21 followed by an inverted U-shaped section 22 in the exit pipe 4, prevents gases from escaping the sewer pipe 20. As the bowl 2 fills, the water level will eventually fill to a level in the inverted U-shaped section 22 that causes the toilet to flush. Even when flushing, water remains in the U-shaped section 21 to prevent gases from escaping the trap 5.

In the commode according to the invention, a bore has been drilled from a top surface between the bowl opening and the flush tank support and down into the trap. A pipe section 8 is then inserted into the bore, forming a channel to the trap. In order to avoid odors from entering through the trap and up through the pipe section 8, the latter may be provided with a membrane. As will be seen in the following, the pipe section may also be dispensed with.

Figure 3:
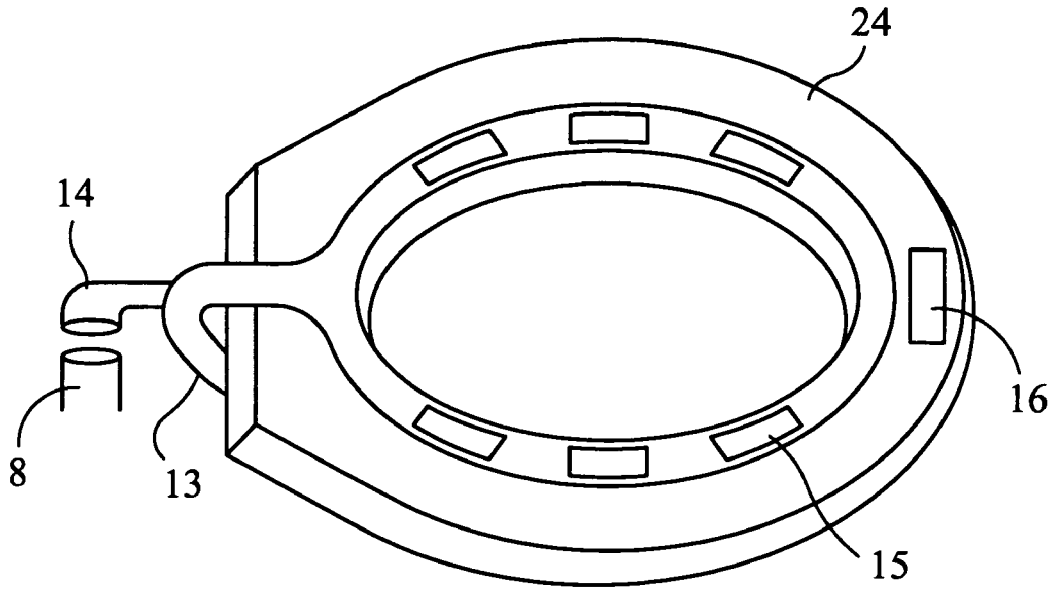
FIG. 3 is a bottom perspective view of a toilet seat according to the invention.

A seat/cover assembly for the commode includes a rim seat 24, as illustrated in bottom perspective view in FIG. 3. The seat 24 is formed with openings 15 that are distributed about the rim seat 24. When the seat 24 is in its horizontal position, the openings circumscribe the bowl opening peripherally. As vacuum is applied to the openings 15, the seat 24 becomes a vacuum device and, accordingly, the bowl is evacuated and the odorous air is drawn off. While the seat 24 in FIG. 3 is shown with a hose assembly, it will be understood that the openings may be completely integrated in the seat.

Figure 4:
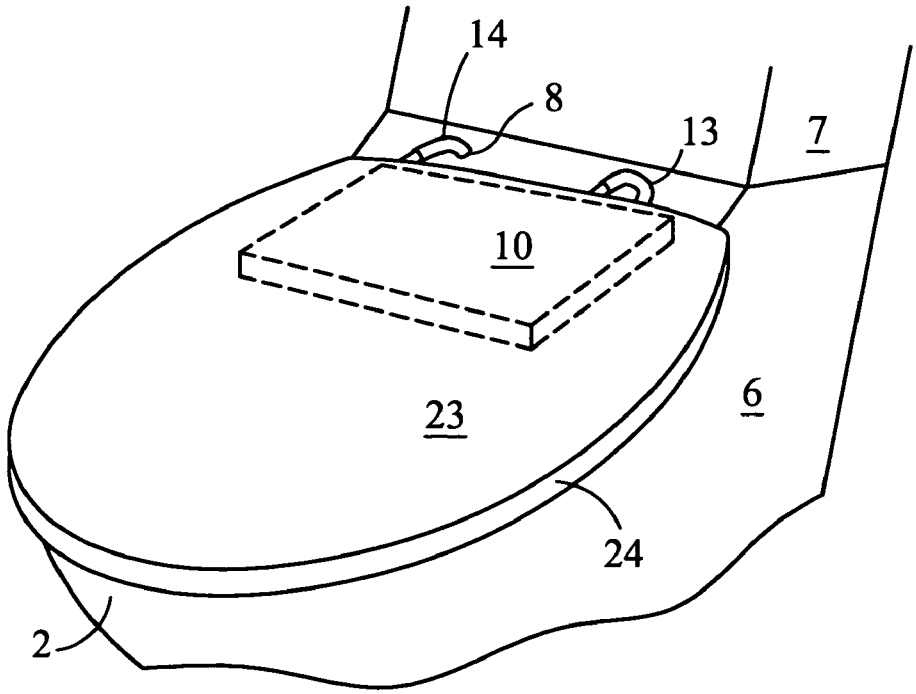
FIG. 4 is a partial front perspective view of a toilet with a system for removing odors according to the invention.

FIG. 4 illustrates the seat/cover assembly placed on the commode 3. An air pump 10 is integrated in an opening in the seat cover 23. The air pump 10 has an inlet communicating with the openings 15 along the seat 24 and an outlet communicating with the trap. The pump 10 moves air from the bowl of the toilet to the inverted U-section 22 of the trap 5. The air taken by the pump 10 from the bowl 2 includes odors in the bowl 2 and prevents their escape.

An inlet hose 13 leads from the openings 15 in the rim seat 24 to a pump housing inlet and an exhaust pipe in the form of a hose 14 leads from the pump to the opening 8 and down into the trap.

Figure 6:
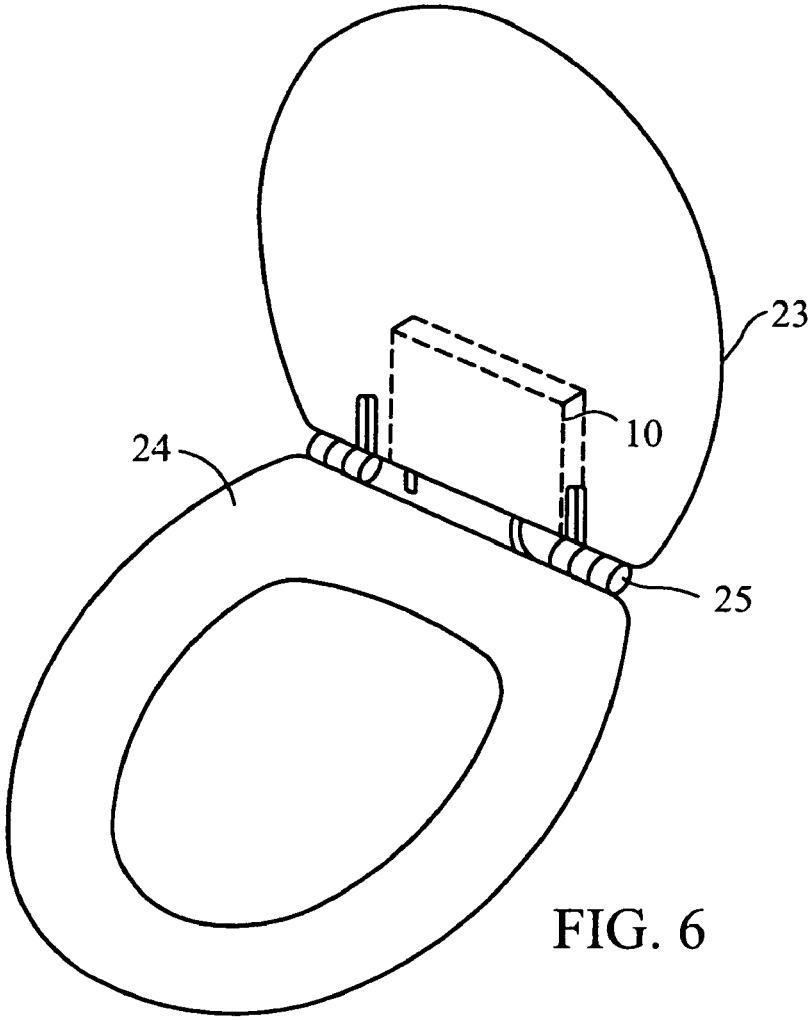
FIG. 6 front top perspective view of a toilet seat assembly according to the invention.

The seat cover 23 in FIG. 6 has been pivoted upward about a hinge 25 interconnecting the cover 23 and the seat 24.

Figure 5:
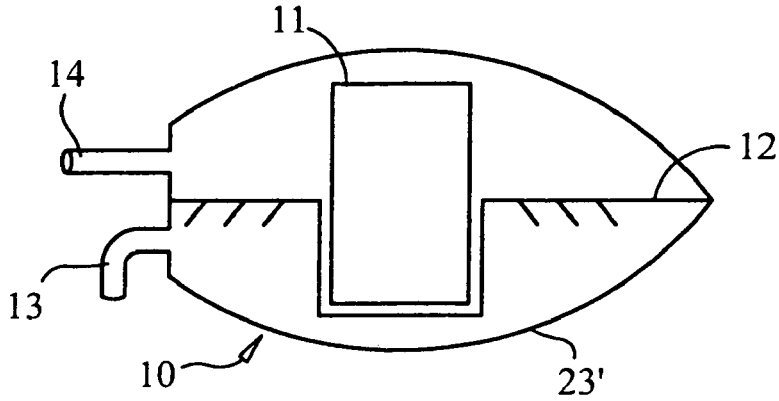
FIG. 5 is a section taken through a toilet seat cover according to the invention.

An alternative embodiment of the seat cover 23 is illustrated in FIG. 5. There the seat cover 23 has an opening housing the pump, i.e., it forms the pump housing with an intake 13 and an outlet 14. A pump motor 11 drives a fan blade 12 to form the necessary vacuum on the intake 13 chamber side and the necessary overpressure at the outlet 14 chamber side.

The motor 11 of either embodiment may be driven with any type of source of electrical energy, such as battery power (with the necessary user-accessible battery compartment suitable placed), mains power (in light of the fact that the toilet bowl is a water appliance, the supply power is provided through an adapter at 6 or 12 V), or even photovoltaic cell-generated power.

The air pump 10 is preferably dimensioned in accordance with the air volume of the bowl 2. For example, it is advisable to evacuate one third of the gas volume of the bowl 2 per second. Other pumping capacities may, of course, be adjusted as well.

The motor 11 may be activated by a switch 16. In the preferred embodiment, the switch 16 is integrated in the bottom of the rim seat 24 and it closes (or opens, depending on the electrical diagram) when a person sits on the seat 24. That is, when a certain amount of pressure (e.g., weight of approx. 25 kg) causes the seat to be downwardly biased onto the rim 3, the switch 16 turns on the motor. Typically, the rim seat 24 is spaced from the rim 3 by resilient stubs. In this case, the switch 16 may be advantageously integrated in one of the stubs.

A standard toilet 1 can be retrofitted with the system for removing odors. In fact, the entire novel system may be distributed in kit form, including the seat 24 with the integrated intake openings 15, the switch 16, the pump inlet 13, the seat cover 23 with the integrated pump 10, and the pump outlet 14. It is then only necessary to drill the hole down into the trap, to insert the downpipe 8, and to connect the downpipe 8 to the pump outlet 14 in a fluid-tight manner.

I claim:

1. In a toilet including an integrated body having a bowl with a rim and having an exit pipe with a trap, the improvement comprising:

the integrated body having a channel formed to the trap;

a toilet seat to be placed on the rim of the bowl, said seat forming a vacuum device with at least one opening in a vicinity of the rim;

a toilet cover to be placed on said toilet seat; and an air pump having a pump inlet communicating with said opening in said toilet seat and a pump outlet communicating with said channel formed to the trap, for evacuating an air volume in the toilet bowl; and said toilet cover being formed with an opening housing said pump.

2. The improved toilet according to claim 1, further comprising a switch to selectively activate and deactivate said air pump.

3. The improved toilet according to claim 1, wherein said seat is formed with a plurality of openings encircling the rim.

4. The improved toilet according to claim 1, wherein said air pump includes a fan.

5. In a toilet including an integrated body having a bowl with a rim and having an exit pipe with a trap, the improvement comprising:

the integrated body having a channel formed to the trap;

a toilet seat to be placed on the rim of the bowl, said seat forming a vacuum device with at least one opening in a vicinity of the rim;

a toilet cover to be placed on said toilet seat; and an air pump having a pump inlet communicating with said opening in said toilet seat and a pump outlet communicating with said channel formed to the trap, for evacuating an air volume in the toilet bowl; and a hinge interconnecting said cover and said seat, and said cover housing said air pump.

6. The improved toilet according to claim 5, which comprises a pressure-activated switch for turning on said air pump when pressure is applied to said seat.

* * * * *